US008075253B2

(12) United States Patent
Bertino

(10) Patent No.: US 8,075,253 B2
(45) Date of Patent: Dec. 13, 2011

(54) GAS TURBINE COMPRESSOR

(75) Inventor: Gianluigi Bertino, Bogliasco (IT)

(73) Assignee: Ansaldo Energia S.p.A., Genoa (IT)

( * ) Notice: Subject to any disclaimer, the term of this patent is extended or adjusted under 35 U.S.C. 154(b) by 434 days.

(21) Appl. No.: 12/304,871

(22) PCT Filed: Jun. 15, 2007

(86) PCT No.: PCT/EP2007/055982

§ 371 (c)(1),
(2), (4) Date: Apr. 10, 2009

(87) PCT Pub. No.: WO2007/144430

PCT Pub. Date: Dec. 21, 2007

(65) Prior Publication Data

US 2009/0208329 A1 Aug. 20, 2009

(30) Foreign Application Priority Data

Jun. 16, 2006 (EP) ..... 06425408

(51) Int. Cl.
*F01D 17/12* (2006.01)

(52) U.S. Cl. ..... 415/162; 415/13; 415/17; 415/118; 415/148

(58) Field of Classification Search ..... 415/13, 415/17, 24, 27, 30, 49, 118, 148, 162
See application file for complete search history.

(56) References Cited

U.S. PATENT DOCUMENTS

| | | | | |
|---|---|---|---|---|
| 5,165,845 | A | 11/1992 | Khalid | |
| 2005/0079046 | A1 * | 4/2005 | Jolibois et al. | 415/13 |

FOREIGN PATENT DOCUMENTS

| | | |
|---|---|---|
| EP | 0 274 931 | 7/1988 |
| EP | 0 381 399 | 8/1990 |
| EP | 0 795 681 | 9/1997 |
| EP | 1 031 703 | 8/2000 |
| FR | 2 688 827 | 9/1993 |
| GB | 2 294 094 | 4/1996 |
| GB | 2 399 865 | 5/2005 |
| GB | 2 410 530 | 8/2005 |

* cited by examiner

*Primary Examiner* — Dung A. Le
(74) *Attorney, Agent, or Firm* — Berenato & White, LLC

(57) ABSTRACT

A gas turbine compressor presents a first fixed stage having a plurality of first adjustable vanes and a further fixed stage, which has an inner ring extending about a first axis; an outer ring arranged about the inner ring and coaxial with the inner ring; and a plurality of second adjustable vanes, each of which extends along a second axis in an essentially radial direction with respect to the first axis between the inner ring and the outer ring; and it is adjustable about the corresponding second axis independently from the first adjustable vanes.

19 Claims, 4 Drawing Sheets

Fig.4
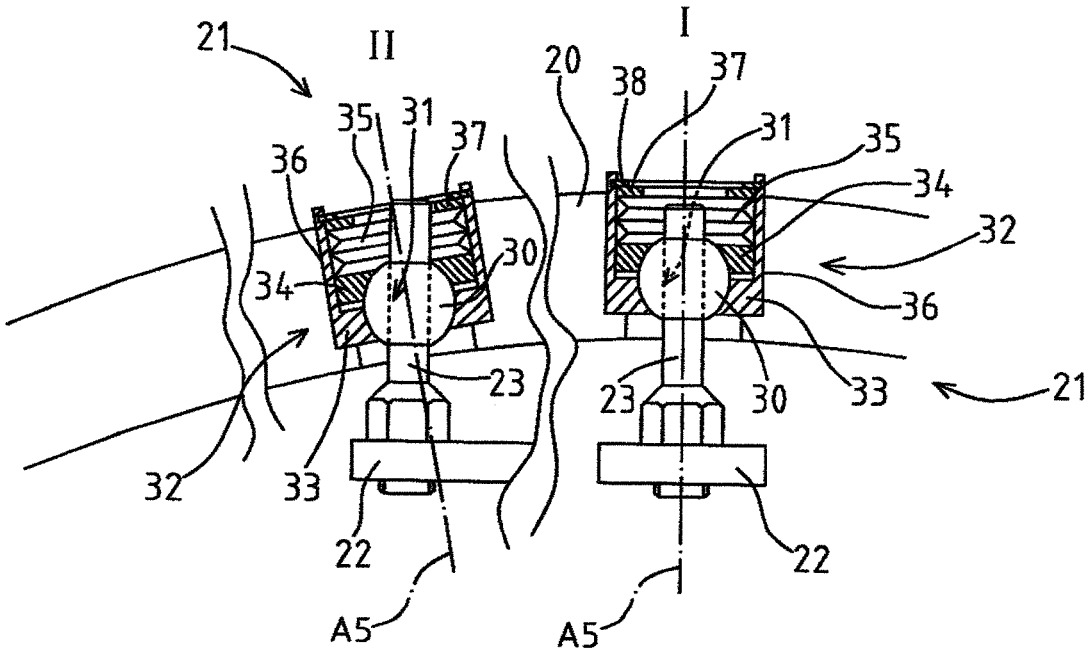
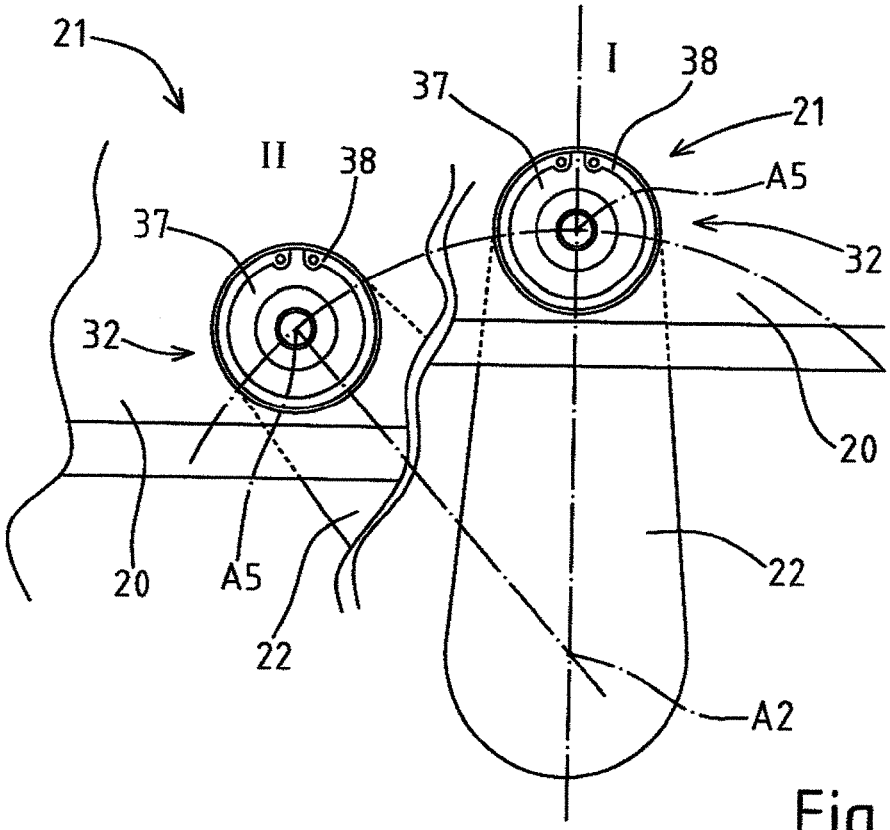
Fig.5

GAS TURBINE COMPRESSOR

CROSS-REFERENCE TO RELATED APPLICATIONS AND CLAIM TO PRIORITY

This application relates to International Application No. PCT/EP2007/055982 filed Jun. 15, 2007 and European Patent Office Application No. 06425408.9 filed Jun. 16, 2006, of which the disclosures are incorporated herein by reference and to which priority is claimed.

TECHNICAL FIELD

The present invention relates to a gas turbine compressor.

BACKGROUND ART

Generally, a gas turbine compressor of the type identified above comprises a plurality of stages including a first fixed stage comprising a plurality of first adjustable vanes and a further fixed stage, which comprises an inner ring extending about a first axis; an outer ring arranged about the inner ring and coaxial with the inner ring; and a plurality of second adjustable vanes, each of which extends about a second axis in essentially radial direction with respect to the first axis between the inner ring and the outer ring.

A gas turbine compressor is crossed by a flow of air in axial direction: the function of the first fixed stage is to convey and orient the flow of air so as to optimise the action of the flow of air on a first impeller arranged directly downstream of the first fixed stage. Similarly, the function of the further fixed stage is to convey and orient the flow of air so as to optimise the action of the flow of air on a further impeller arranged directly downstream of the further fixed stage.

The orientation of the flow of air is obtained by adjusting the orientation of the first vanes in the first fixed stage and the orientation of the second vanes in the further fixed stage.

For this purpose, a gas turbine compressor of the known type is equipped with an adjusting device which allows to simultaneously adjust the orientation of the first vanes and of the second vanes.

This adjusting device has been proven inadequate because it requires the identification of a half-measure adjustment position: in other words, an optimal orientation of the first vanes does not correspond to an optimal orientation of the second vanes. For this reason, the functions of the compressor, and consequently of the gas turbine, cannot be optimised.

Furthermore, the adjusting device of the known type requires to adapt the shape and dimensions of the further fixed stage to the structure of the adjustment device.

DISCLOSURE OF THE INVENTION

It is the object of the present invention to make a gas turbine compressor comprising a first fixed stage having a plurality of first adjustable vanes and a further fixed stage having a plurality of second adjustable vanes which is free from the drawbacks of the prior art and is simple and cost-effective to make.

A gas turbine compressor is made according to the present invention; the compressor comprising a first fixed stage comprising a plurality of first adjustable vanes and a further fixed stage comprising a plurality of first adjustable vanes and a further fixed stage, which comprises an inner ring extending about a first axis; an outer ring arranged about the inner ring and coaxial with the inner ring; and a plurality of second adjustable vanes, each of which extends along a second axis in an essentially radial direction with respect to the first axis and between the inner ring and the outer ring; the compressor being characterised in that each of the second vanes is adjustable about the corresponding second axis independently from the first adjustable vanes.

According to the present invention, the flow of air may be independently oriented and optimised along the first and the further fixed stage in order to optimise the efficiency and functions of the compressor.

According to a preferred embodiment of the invention, the compressor comprises an adjusting device adapted to solely adjust the orientation of the second vanes comprising: a plurality of levers, each of which is fixed to a corresponding second vane and is turnable about the second axis to adjust said second vane; an adjustment ring turnable about the first axis; and a plurality of ball joints, each of which is adapted to connect a corresponding lever to the adjustment ring.

Each ball joint allows to ensure an accurate, clearance-free coupling between the corresponding lever and the adjustment ring.

According to a further preferred embodiment of the invention, each ball joint comprises: a ball joint body coupled to a corresponding lever; and a housing element of said spherical body; said housing element being fixed to the adjustment ring.

Assembly of the adjusting device is particularly simply thanks to the ball joint fastening to the adjustment ring.

According to a further embodiment of the present invention, each housing element comprises: a first bushing provided with a face adapted to be coupled by shape with the spherical body; a second bushing provided with a face adapted to be coupled by shape with the spherical body; and elastic means for elastically fastening the spherical body between the first and second bushings.

In this way, an automatic clearance take-up system is created for cancelling any ball joint clearance and eliminating possible vibrations.

BRIEF DESCRIPTION OF THE DRAWINGS

For a better understanding of the present invention, a preferred embodiment thereof will now be described only by way of non-limitative example, and with reference to the accompanying drawings, in which:

FIG. 4 is a frontal view of a detail with parts removed for clarity and parts in section, of a detail in FIG. 2 in a first operative position I and a second operative position II; and FIG. 5 is a side view of a detail with parts removed for clarity and parts in section, of the detail in FIG. 2 in a first operative position I and a second operative position II.

BEST MODE FOR CARRYING OUT THE INVENTION

Figure 1:
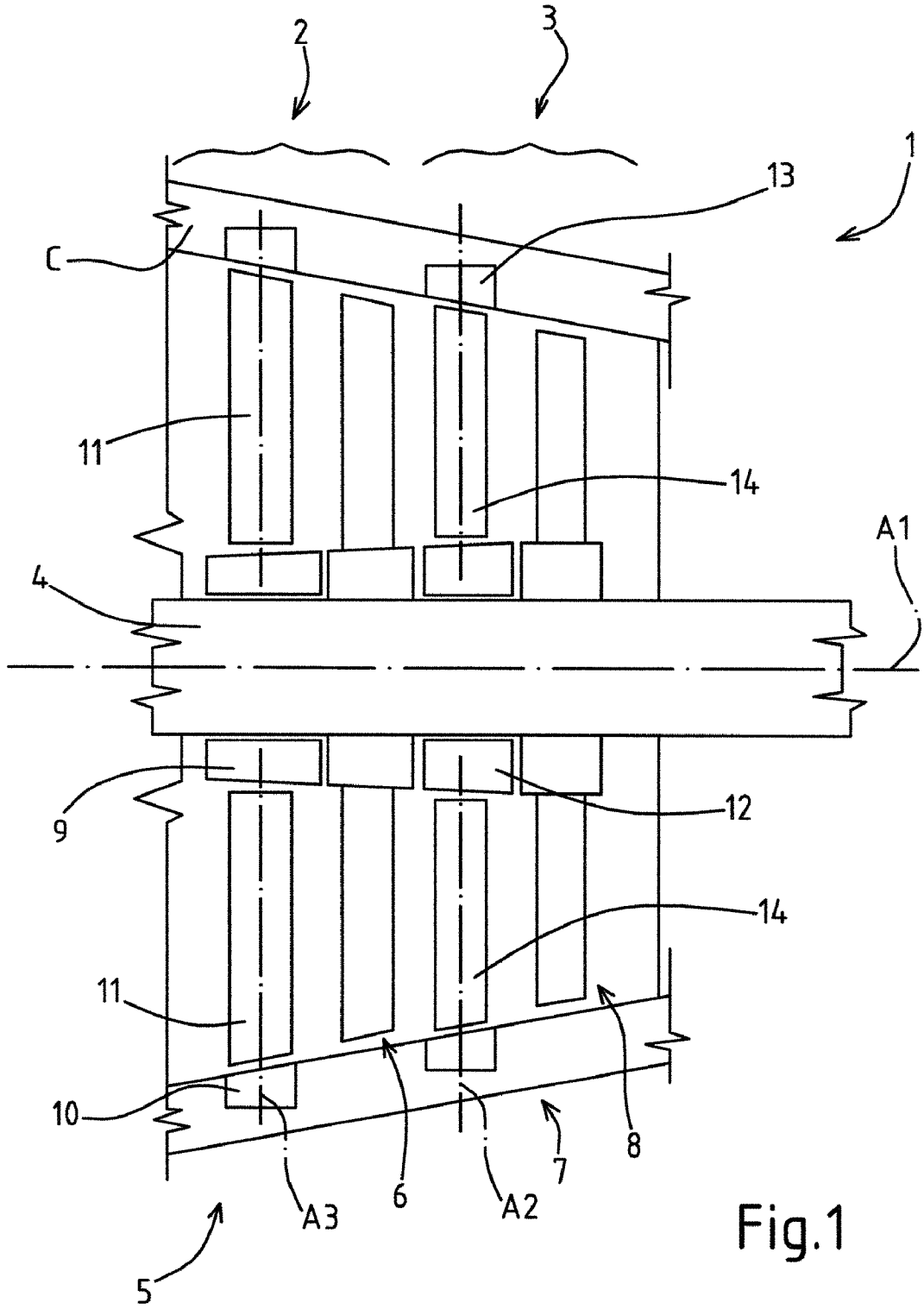
FIG. 1 is a longitudinal section schematic view, with parts removed for clarity, of a portion of a gas turbine compressor made according to the present invention.

With reference to FIG. 1, it is indicated as a whole by 1 a compressor of the axial type which extends along an axis A1 and comprises a first stage 2; a second stage 3; and a shaft 4 which extends along axis A1 and is turnable about axis A1. Compressor 1 comprises a casing C having an essentially tapered shape in which a flow of air is conveyed. The first stage 2 comprises a first fixed stage 5, and a first impeller 6, which is arranged directly downstream of the first fixed stage 5 and is fitted on shaft 4; the second stage 3 comprises a second fixed stage 7 and an impeller 8, which is arranged directly downstream of the second fixed stage 7 and is keyed on shaft 4. The first fixed stage 5 comprises an inner ring 9, an outer ring 10 coaxial with inner ring 9, and a plurality of vanes 11, each of which extends between the inner ring 9 and the outer ring 10.

The second fixed stage 7 comprises an inner ring 12 extending about the first axis A1; and an outer ring 13 arranged about inner ring 12 and coaxial with inner ring 12; and a plurality of vanes 14, each of which extends between inner ring 12 and outer ring 13 and is turnable about an axis A2, which is arranged in an essentially radial direction with respect to the first axis A1 and between inner ring 12 and outer ring 13. Similarly, each of the vanes 11 is adjustable about an axis A3 arranged in essentially radial direction with respect to axis A1.

Vanes 14 are adjustable about the corresponding axis A2 in unison and independently from the first adjustable vanes 11. For this purpose and with reference to FIG. 2, each vane 14 is turnably fitted to inner ring 12 and outer ring 13. In the case in point in FIG. 2, each vane 14 presents two pins 15 and 16 aligned along axis A2 and accommodated in respective seats 17 and 18 made respectively in the inner ring 12 and in the outer ring 13.

Compressor 1 comprises an adjusting device 19, which comprises: an adjustment ring 20, which extends about outer ring 13 and is turnably mounted about first axis A1; a plurality of ball joints 21, each of which is fitted on adjustment ring 20; a plurality of levers 22, each of which is fixed to a pin 16 of a corresponding vane 14; and a plurality of pins 23, each of which is integral with a corresponding lever 22 and is slidingly coupled to a corresponding ball joint 21.

Each vane 14, corresponding lever 22, and corresponding pin 23 are connected so as to form a rigid element. Lever 22 has a first end fixed to pin 16 of the corresponding vane 14 and is arranged perpendicularly to axis A2, and a second end which is fixed to the corresponding pin 23, which is essentially parallel to axis A2.

Figure 2:
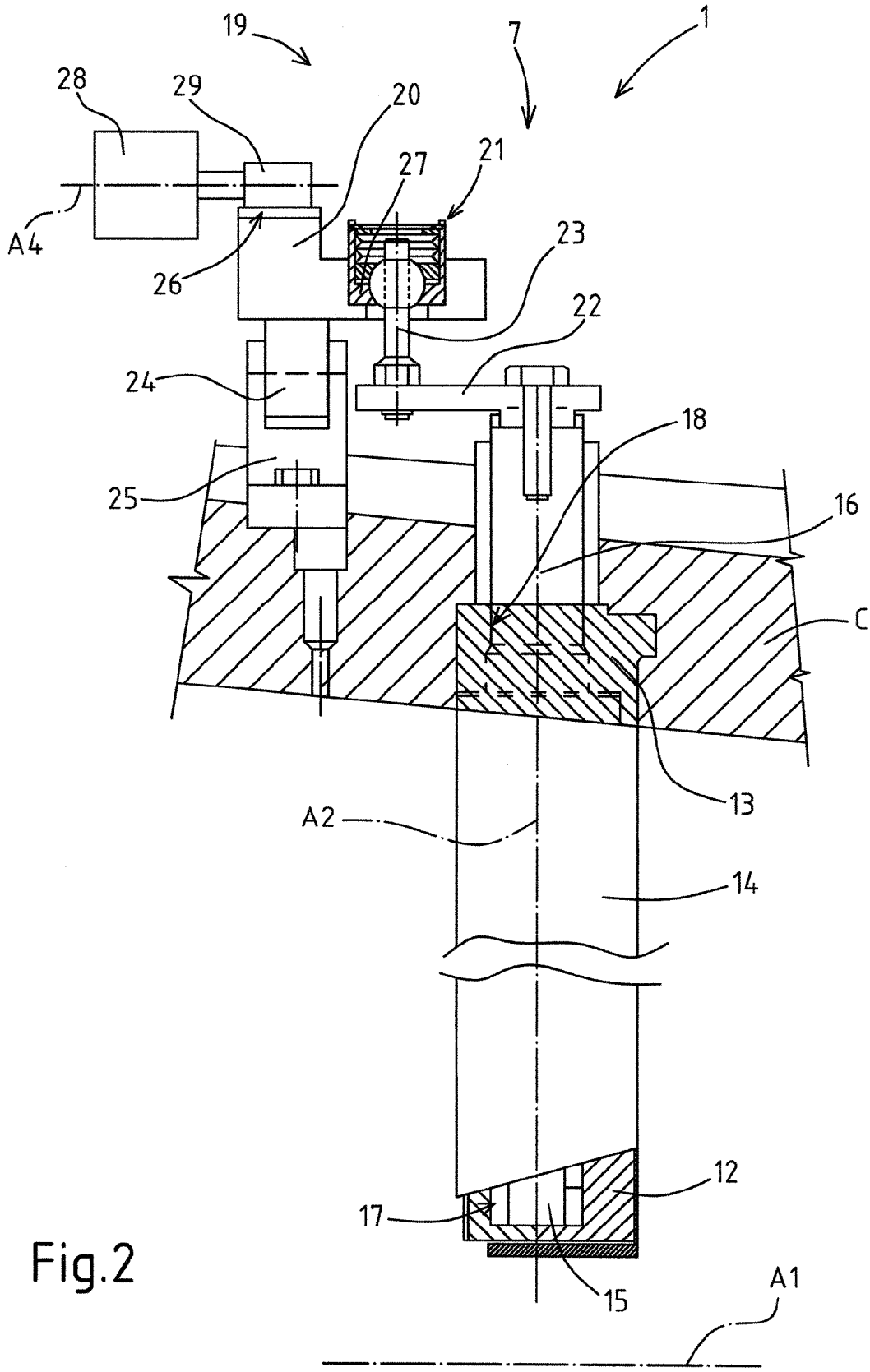
FIG. 2 is a longitudinal section schematic view, on magnified scale and with parts removed for clarity, of a detail of the compressor in FIG. 1.

The adjustment ring 20 is fitted on a plurality of bearings 24 (only one of which is shown in FIG. 2), which are evenly distributed about axis A1 and about casing C and are fitted on respective supports 25 fixed to casing C. Adjustment ring 20 has a toothed segment 26 and a plurality of seats 27 uniformly distributed about axis A1. Adjustment ring 20 rests on bearings 25, which in addition to ensuring low-friction rotation of adjustment ring 20 about axis A1, allow adjustment ring 20 to slide in a direction parallel to axis A1 with respect to bearings 24.

Adjusting device 19 further comprises a drive member 28 adapted to turn a pinion 29, which turns about an axis A4 parallel to axis A1 and engages the toothed segment 26 to selectively turn in one direction or in the opposite direction of the adjustment ring 20.

Figure 3:
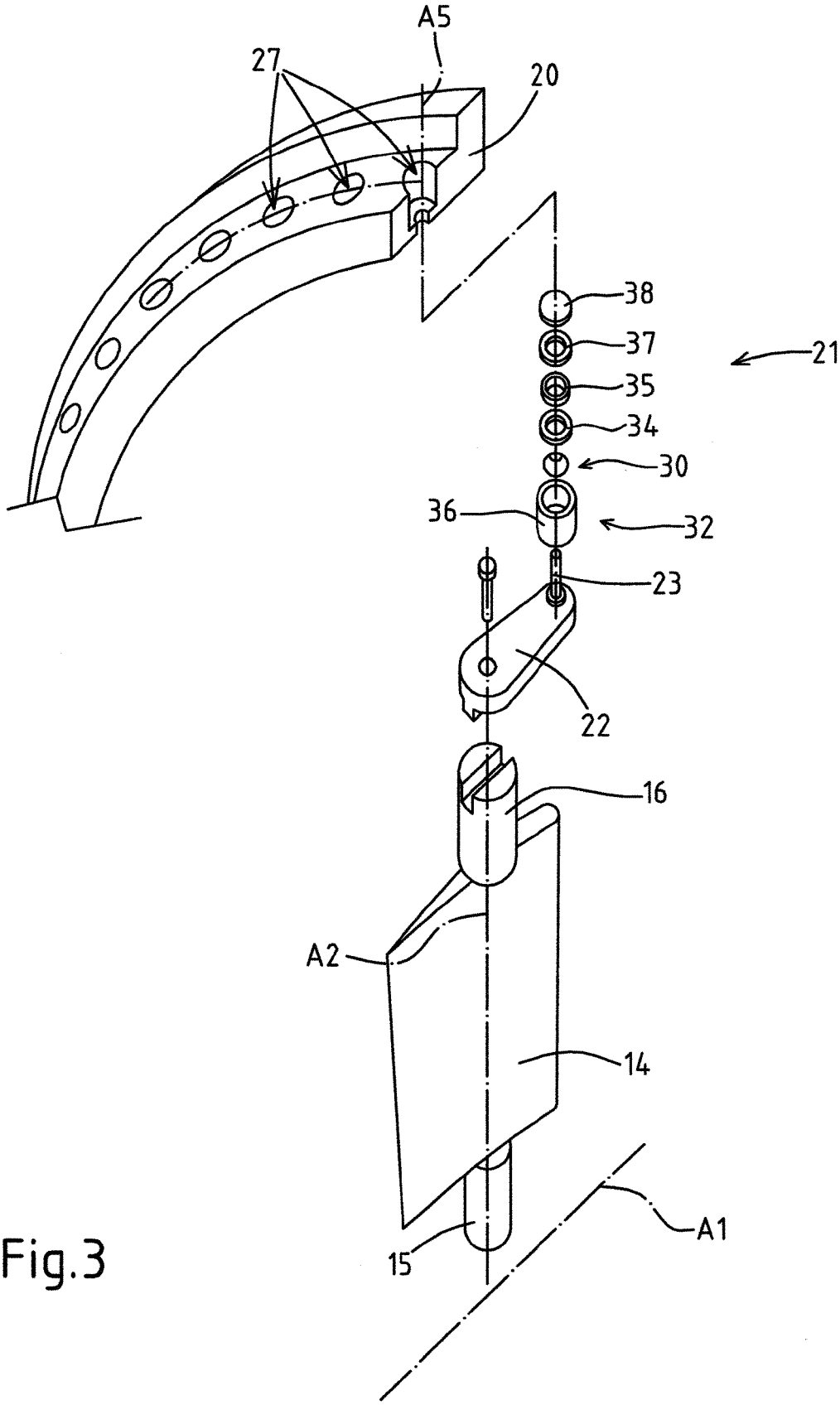
FIG. 3 is an exploded view, with parts removed for clarity and parts in section, of an adjusting device of the compressor in FIG. 1.

With reference to FIG. 3, each seat 27 extends about an axis A5 perpendicular to axis A1 and is formed in the thickness of adjustment ring 20, is a through-hole and presents an annular locator wall.

With reference to FIG. 4, each ball joint 21 comprises a spherical body 3 provided with a through-hole 31 (FIG. 4) for slidingly accommodating corresponding pin 23; and a housing element 32 of the spherical body 30, which comprises: a first bushing 33 (FIG. 4) provided with a face adapted to be coupled by shape with the spherical body 30; a second bushing 34 provided with a face adapted to be coupled by shape with the spherical body 30; and springs 35 for elastically fastening the spherical body 30 between the first and second bushings 33 and 34.

With reference to FIG. 4, housing element 32 is essentially cup-shaped and comprises a side wall 36 provided with an outer threading, and a bottom wall which is essentially defined by first bushing 33. Each housing element 32 is fastened in a corresponding (threaded) seat 17 of adjustment ring 20.

First bushing 33 presents a through-hole for allowing the insertion of a corresponding pin 23, while second bushing 34 is provided with a through-hole for allowing the passage of pin 23, is capable of sliding along the housing element 32 and is guided by the side wall 36.

Housing element 32 comprises a plate 37, which is fixed within side wall 36 so as to form a locator for the elastic means which are compressed between plate 37 and the second bushing 34; and a snap ring 38 (FIGS. 3 and 5) engaged in an annular seat arranged along cylindrical wall 36 to lock plate 37.

In the case in point in FIG. 4, springs 35 are counterpoised Belleville springs.

Each housing element 32 has an essentially cylindrical shape and is fastened in a corresponding appropriately threaded seat 27 of adjustment ring 20. First bushing 33 is abuttingly arranged against the annular locator wall of seat 27, while corresponding spherical body 30 is slidingly coupled to a corresponding pin 23.

In use, adjustment ring 20 is selectively turned about axis A1 in both directions of rotation by means of drive member 28 and pinion 29 to determine the simultaneous and agreeing rotation of all vanes 14 about their axes A2 independently from vanes 11.

With reference to a single vane 14 and to FIGS. 4 and 5, the rotations of adjustment ring 20 are minor about a first operative reference position shown in FIGS. 4 and 5 and indicated by I. Adjustment ring 20 may take a plurality of operative positions about the first operative reference position I. A second operative position is shown by II in FIGS. 4 and 5. As may be noted in FIGS. 4 and 5, the rotation of the adjustment ring 20 between the first operative position I and the second operative position II determines at the same time:

a) a rotation of lever about axis A2;

b) a rotation of vane 14 about axis A2 due to the rotation of lever 22;

c) a shift of adjustment ring 20 in a direction parallel to axis A1 with respect to bearing 24 due to the fact that the distance between axis A2 and corresponding axis AS of seat 27 of adjustment ring 20 is reduced in direction parallel to axis A1;

d) a sliding of pin 23 within the spherical body 30 caused by the reduction of the distance between lever 22 and adjustment ring 20; and e) a rotation of spherical body 30 with respect to the first and second bushings 33 and 34 determined by the presence of pin 23 within the spherical body.

In other words, the adjusting device 19 is a kinematic system with a single degree of freedom and therefore the shift of an element of the kinematic chain determines the shift of the other elements of the kinematic chain.

According to an embodiment not shown in the attached figures, pin 23 is perpendicular to corresponding axis A2; axis AS of corresponding seat 27 is parallel to axis A1; and lever 22 slides along axis A2 with respect to corresponding vane 14. According to this embodiment (not shown), adjustment ring 20 may be secured so as to prevent shifts along axis A1.

In addition to the advantages described above, the compressor 1 described and claimed is particularly advantageous because adjusting device 19 does not require specific structural changes which respect to a fixed stage compressor provided with non-adjustable vanes: indeed, adjusting device 19 requires seats 17 and 18 to be made respectively in inner ring 12 and in outer ring 13 and to fix supports 25 of bearings 24 on casing C. Some additional mechanical machining is therefore required. Furthermore, adjusting device 19 according to the present invention is compact in size.

The invention claimed is:

1. A gas turbine compressor comprises a first fixed stage (5) comprising a plurality of first adjustable vanes (11) and further fixed stage (7), which comprises an inner ring (12) extending about a first axis (A1); an outer ring (13) arranged about the inner ring (12) and coaxial with the inner ring (12); and a plurality of second adjustable vanes (14), each of which extends along a second axis (A2) in an essentially radial direction with respect to the first axis (A1) and between the inner ring (12) and the outer ring (13); wherein each of the second vanes (14) is adjustable about the corresponding second axis (A2) independently from the first adjustable vanes (11).

2. A compressor according to claim 1, further comprising an adjusting device (19) adapted to solely adjust the orientation of the second vanes (14) and comprising: a plurality of levers (22), each of which is fixed to a corresponding second vane (14) and is turnable about the second axis (A2) to adjust said second vane (14); an adjustment ring (20) turnable about the first axis (A1); and a plurality of ball joints (21), each of which is adapted to connect a corresponding lever (22) to the adjustment ring (20).

3. A compressor according to claim 2, further comprising a casing (C) wherein the adjustment ring (20) is arranged about said casing (C).

4. A compressor according to claim 3, wherein the adjustment ring (20) is fitted on bearings (24) fitted on supports (25) fixed to casing (C).

5. A compressor according to claim 2, wherein each lever (22) is integral with a pin (23); each ball joint (21) being slidingly engaged by corresponding pin (23) along pin (23) itself.

6. A compressor according to claim 5, wherein each lever (22) is perpendicular to corresponding axis (A2); each pin (23) being essentially parallel to corresponding axis (A2).

7. A compressor according to claim 6, wherein each vane (14) forms a single rigid element with corresponding lever (22) and corresponding pin (23).

8. A compressor according to claim 5, wherein each ball joint (21) comprises a spherical body (30) provided with a through-hole (31) to slidingly accommodate corresponding pin (23).

9. A compressor according to claim 2, wherein said adjustment ring (20) is mobile in a direction parallel to the first axis (A1).

10. A compressor according to claim 1, wherein each ball joint (21) comprises: a spherical body (30) coupled to a corresponding lever (22); and a housing element (32) of said spherical body (30); said housing element (32) being fixed to said adjustment ring (20).

11. A compressor according to claim 10, wherein each housing element (32) comprises: a first bushing (33) provided with a face adapted to be coupled by shape with the spherical body (30); a second bushing (34) provided with a face adapted to be coupled by shape with spherical body (30); and elastic means (35) for elastically fastening spherical body (30) between the first and second bushings (33, 34).

12. A compressor according to claim 11, wherein each housing element (32) comprises a cylindrical side wall (36) integral with the first bushing (33); the second bushing (34) being mobile within said side wall (36) and being guided by said side wall (36).

13. A compressor according to claim 12, wherein each ball joint (21) comprises a plate (37) fixed within side wall (36) so as to form a locator for elastic means (35) which are arranged between said plate (37) and the second bushing (38).

14. A compressor according to claim 13, wherein said elastic means (35) are Belleville springs.

15. A compressor according to claim 14, wherein said Belleville springs are reciprocally counterpoised.

16. A compressor according to claim 12, wherein each ball joint (21) comprises a snap ring (38) engaged in an annular seat arranged within side wall (36) to lock said plate (37).

17. A compressor according to claim 2, wherein adjustment ring (20) comprises a plurality of seats (27) uniformly arranged about the first axis (A1), each ball joint (21) being fixed into a corresponding seat (27).

18. A compressor according to claim 2, further comprising a pinion (29) selectively turnable about a third axis (A4) parallel to the first axis (A1); adjustment ring (20) comprising a toothed segment (26) meshing with said pinion (29).

19. A compressor according to claim 1, wherein said further fixed stage (3) is the second fixed stage.

* * * * *